US006733301B2

(12) United States Patent
Brown, III

(10) Patent No.: US 6,733,301 B2
(45) Date of Patent: May 11, 2004

(54) ELECTRICAL CONNECTOR FOR JOINING CIRCUIT BOARDS

(75) Inventor: John B. Brown, III, Dillsburg, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/215,814

(22) Filed: Aug. 9, 2002

(65) Prior Publication Data

US 2004/0029408 A1 Feb. 12, 2004

(51) Int. Cl.[7] ..... H01R 12/00
(52) U.S. Cl. ..... 439/65
(58) Field of Search ..... 439/65, 224, 31, 439/67, 101, 608

(56) References Cited

U.S. PATENT DOCUMENTS 4,632,475 A * 12/1986 Tomita ..... 439/1
5,674,078 A 10/1997 Davis et al. ..... 439/79
5,727,961 A 3/1998 Landis et al. ..... 439/287
6,319,075 B1 * 11/2001 Clark et al. ..... 439/825
6,350,154 B1 * 2/2002 Fu ..... 439/638

* cited by examiner

*Primary Examiner*—Ross Gushi

(57) ABSTRACT

An electrical connector is provided for joining circuit boards oriented at an angle to, and closely proximate to, one another. The connector includes a header having a bottom wall. The bottom wall includes a lower face configured to adjoin a first circuit board and an upper face with a plate contact. The plate contact is configured to electrically communicate through the bottom wall with the first circuit board. The connector includes a receptacle having a rear wall configured to adjoin a second circuit board and a receptacle channel that receives a receptacle contact configured to electrically communicate through the rear wall with the second circuit board. The receptacle channel opens onto front and lower faces of the receptacle to define front and lower slots in the front and lower faces, respectively. The plate contact is inserted through the front and lower slots when the header and receptacle are joined.

22 Claims, 8 Drawing Sheets

42
44
72
74
14
54
50
34
46
58
70
62
38
66
58

ELECTRICAL CONNECTOR FOR JOINING CIRCUIT BOARDS

BACKGROUND OF THE INVENTION

The present invention generally relates to a connector for connecting circuit boards oriented at an angle to one another and more particularly relates to an electrical connector that connects a backplane board and a daughter card in close proximity to one another.

In certain computer applications, such as telecommunications computer systems, large printed circuit boards called backplane boards are retained within a computer cabinet and are electrically connected to several smaller printed circuit boards called daughter cards. The terms "board" and "card" are used interchangeably throughout. In the telecommunications industry, by way of example only, daughter cards carry processing programs that allow the backplane board to route information. Optionally, parallel rows of daughter cards are oriented at an angle, such as acutely or perpendicularly, to the backplane board. The common parallel alignment of multiple daughter cards is, in part, due to the need to afford a space-efficient and good signal quality connection with the backplane. A right-angle electrical connector connects the daughter cards to the backplane board at a perpendicular orientation.

FIGS. 6–8 illustrate a conventional right angle electrical connector that has a receptacle housing 204 (FIG. 6) and a header housing 230 (FIG. 7). As shown in FIG. 6, receptacle contacts 270, retained in the receptacle housing 204, have compliant pins 206 that extend from a first end 208 of the receptacle housing 204. The compliant pins 206 are received in apertures in the backplane board (not shown). Parallel slots 210 located at a second end 214 of the receptacle housing 204 extend into receptacle channels 218 within the receptacle housing 204. The receptacle channels 218 are separated by divider walls 222 and enclosed by side walls 226.

As shown in FIG. 7, the header housing 230 has a box-shaped first chamber 234 that retains plate contacts 238 which are aligned parallel to each other. The plate contacts 238 are enclosed by top, bottom, and side walls 242, 246, and 250. As shown in FIG. 8, the header housing 230 is formed with first and second chambers 234 and 254, and the plate contacts 238 extend through both the first and second chambers 234 and 254. The plate contacts 238 include a blade portion 239 held proximate a rear end 262 of the first chamber 234, and compliant pins 266 that extend from the second chamber 254 in a direction perpendicular to the blade portion 239. The compliant pins 266 of the header housing 230 are received in apertures in a daughter card 280 and connected to electrical traces (not shown) in the daughter card 280. The compliant pins 206 of the receptacle housing 204 are received in apertures in a backplane board 281 and connected to electrical traces (not shown) in the backplane board 281.

In operation, the header housing 230 is connected to the receptacle housing 204 such that the first chamber 234 of the header housing 230 receives the second end 214 of the receptacle housing 204 as the receptacle channels 218 (FIG. 6) in the receptacle housing 204 receive the plate contacts 238 in the first chamber 234 of the header housing 230. Thus, the compliant pins 266 of the header housing 230 are oriented perpendicularly to the compliant pins 206 of the receptacle housing 204, and the daughter card 280 is oriented perpendicularly to the backplane board 281. As the plate contacts 238 enter the receptacle channels (FIG. 6) of the receptacle housing 204, the plate contacts 238 engage the receptacle contacts 270 within the receptacle housing 204 such that the compliant pins 206 and 266 of the receptacle and header housings 204 and 230 are electrically connected. The compliant pins 106 may transmit power to the compliant pins 266, or vice versa.

However, the typical right angle electrical connector suffers from several drawbacks. The header housing takes up a great deal of space within the cabinet. Because the receptacle housing is received in a first chamber that is connected to the backplane board through a second chamber, the header housing distances the daughter card from the backplane board by a space equal to the length of the first chamber. In the example of FIGS. 6–7, this spacing equals the length of the first chamber 234. Because the daughter cards are spaced apart from the backplane board by this distance, smaller backplane boards and daughter cards may be positioned in a given cabinet. Thus, conventional right angle electrical connectors limit the space efficiency of a computer system. Additionally, because of the great distance between the backplane board and the daughter cards, the current flowing therebetween must travel across a long path and thus induces high inductance. The high inductance results in slow and inefficient power transmission between the backplane board and the daughter cards.

A need remains for an electrical connector that overcomes the above problems and addresses other concerns experienced in the prior art.

BRIEF SUMMARY OF THE INVENTION

Certain embodiments of the present invention include an electrical connector for joining circuit boards oriented at an angle to one another and in close proximity to one another. A header housing with a bottom wall and a side wall. The bottom wall includes a lower face configured to adjoin a first circuit board and an opposed upper face. The first housing has a plate contact extending upward from the upper face. The plate contact is configured to electrically communicate through the bottom wall with the first circuit board. The electrical connector includes a receptacle housing having a rear wall configured to adjoin a second circuit board and a receptacle channel formed in the receptacle housing. The receptacle channel securely receives a receptacle contact that extends along a longitudinal axis and is configured to electrically communicate through the rear wall with the second circuit board. The receptacle channel opens onto front and lower faces of the receptacle housing to define front and lower slots in the front and lower faces, respectively. The plate contact is inserted through the front and lower slots when the header and receptacle housings are joined to retain the circuit boards closely adjacent one another.

Figure 1:
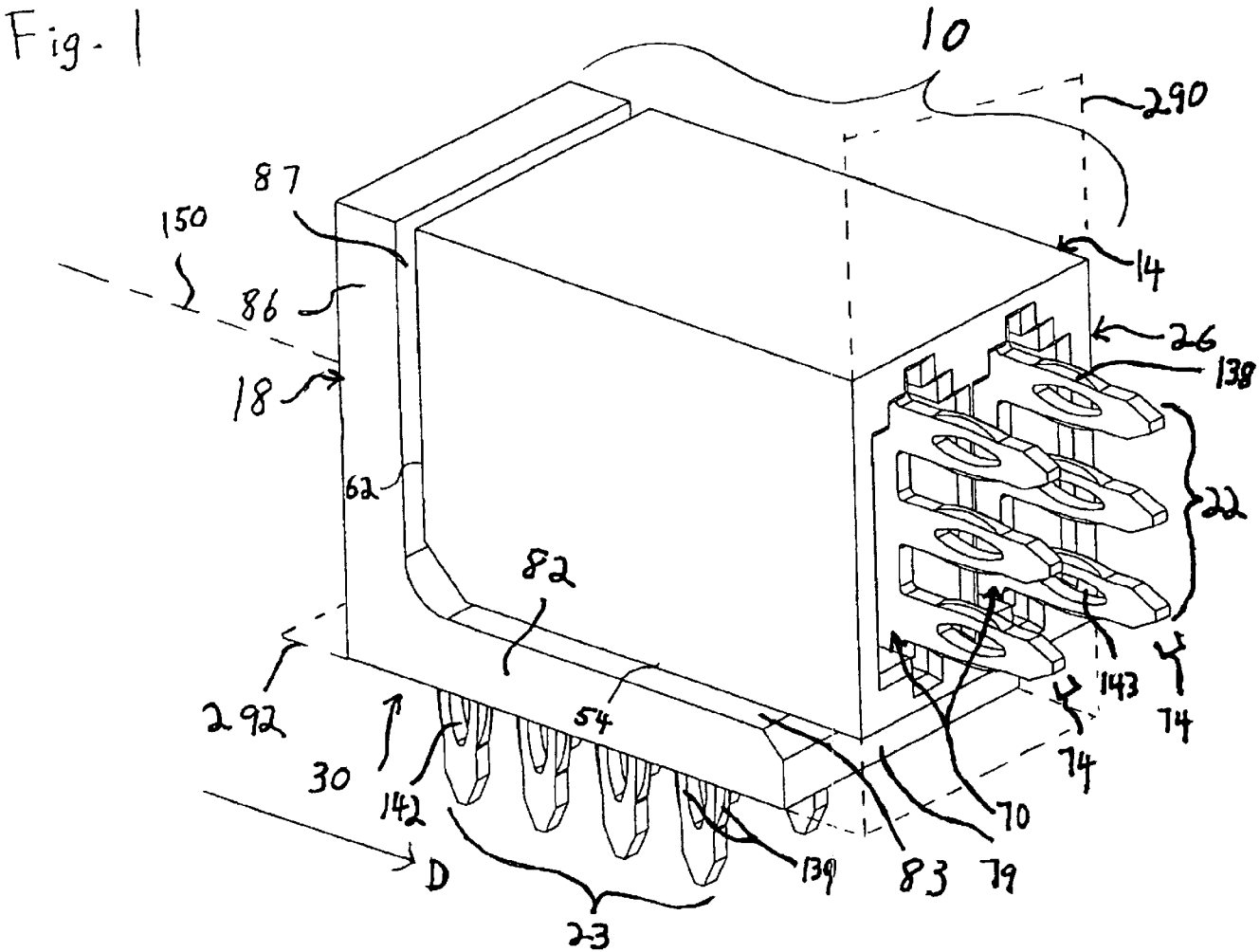
FIG. 1 illustrates an isometric view of a right angle connector formed according to an embodiment of the present invention.

The foregoing summary, as well as the following detailed description of certain embodiments of the present invention, will be better understood when read in conjunction with the appended drawings. For the purpose of illustrating the invention, there is shown in the drawings, certain embodiments. It should be understood, however, that the present invention is not limited to the arrangements and instrumentality shown in the attached drawings.

DETAILED DESCRIPTION OF THE INVENTION

FIG. 1 illustrates an isometric view of an angled connector 10 formed according to an embodiment of the present invention. The angled connector 10 includes an insulated box-shaped receptacle housing 14 and an insulated L-shaped header housing 18. Conductive compliant pins 22 and 23 extend from a rear end 26 of the receptacle housing 14 and a bottom side 30 of the header housing 18, respectively. Alternatively, solder tail pins may extend from the bottom side of the header housing 18. The compliant pins 22 and 23 of the receptacle housing 14 and the header housing 18 are oriented to extend perpendicularly to each other and are electrically connected to each other within the receptacle housing 14. The compliant pins 22 of the receptacle housing 14 are aligned in parallel rows 74. Each row 74 of compliant pins 22 extends from a corresponding receptacle channel 70 in the rear end 26 of the receptacle housing 14. Each compliant pin 22 and 23 of the receptacle and header housings 14 and 18 has bowed side portions 138 and 139 with a gap 142 and 143 therebetween.

The compliant pins 22 and 23 are interference fitted within apertures in circuit boards mated to the angled connector 10 such that the side portions 138 and 139 are pushed inward toward each other into the gap 142 and 143 and resistibly engage the aperture walls in the circuit boards. The angled connector 10 thus is used to electrically connect circuit boards oriented at an angle (acute, perpendicular or obtuse) to one another. The compliant pins 22 may transmit power to the compliant pins 23, or vice versa. By way of example only, the compliant pins 22 extending from the rear end 26 of the receptacle housing 14 are received in apertures in a backplane board 290, and the compliant pins 23 extending from the bottom side 30 of the header housing 18 are received in apertures in a perpendicularly oriented daughter card 292. Alternatively, solder tail pins extending from the bottom side 30 of the header housing 18 may be soldered to traces on a perpendicularly oriented daughter card 292. The angled connector 10 enables the backplane board 290 and daughter card 292 to be located immediately adjacent one another, such as in an abutting relation or spaced apart by a few millimeters or centimeters.

Figure 2:
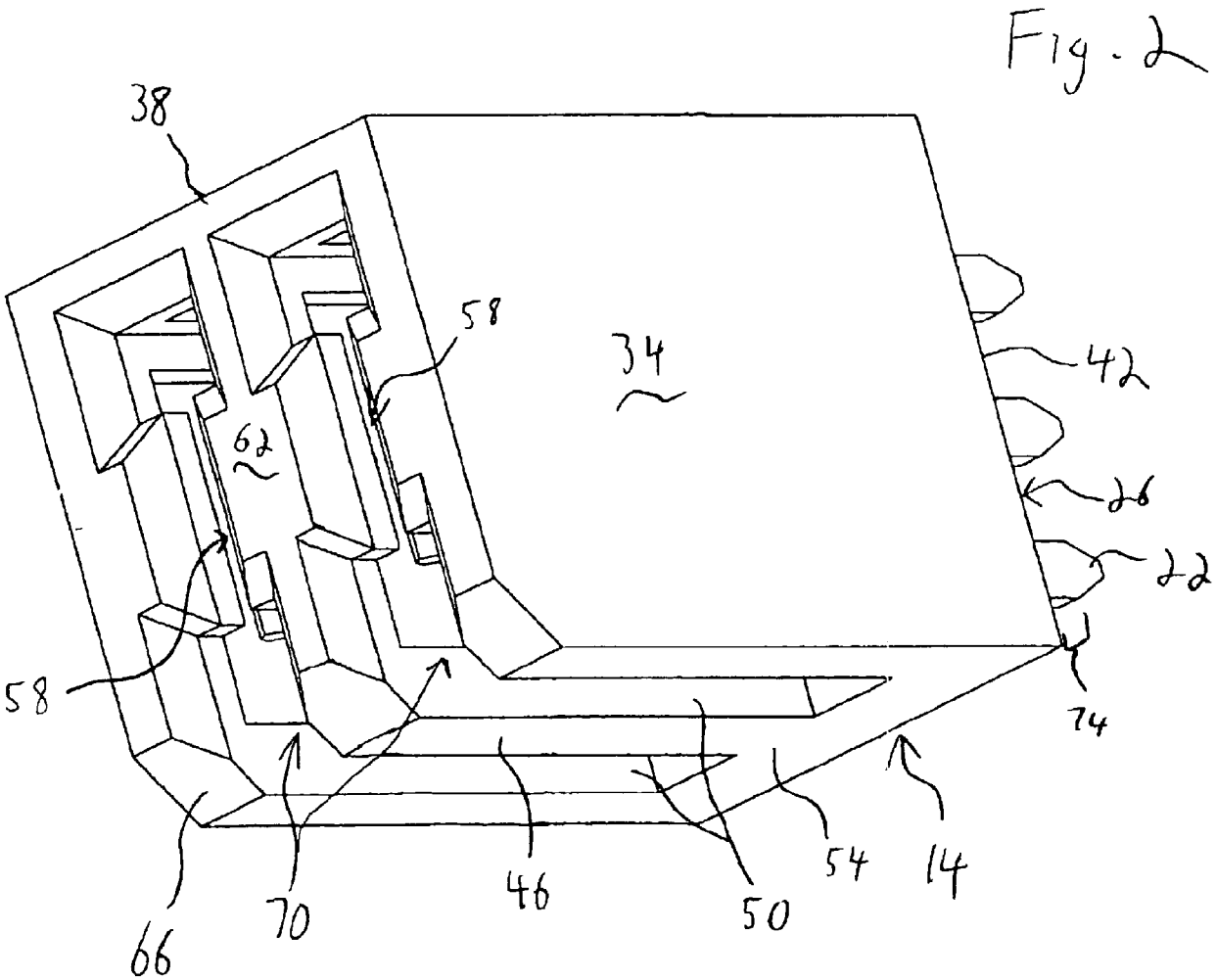
FIG. 2 illustrates an isometric view of a receptacle housing formed according to an embodiment of the present invention.

FIG. 2 illustrates an isometric view of the receptacle housing 14 formed according to an embodiment of the present invention. The receptacle housing 14 has side walls 34 formed with, and extending perpendicularly from, a top wall 38 and a rear wall 42. A divider wall 46 extends between, and parallel to, the side walls 34 from the top and rear wall 38 and 42. The divider wall 46 and the side walls 34 define parallel receptacle channels 70 within the receptacle housing 14. The receptacle channels 70 open onto bottom slots 50 and front slots 58. The bottom slots 50 are rectangular and formed in a bottom mating face 54. The bottom slots 50 merge at a beveled receptacle corner 66 with the front slots 58 that are formed in a front mating face 62. Each row 74 of compliant pins 22 extends from a corresponding receptacle channel 70 through the rear wall 42 at the rear end 26 of the receptacle housing 14. The front slots 58 also provide space for application tooling.

Figure 3:
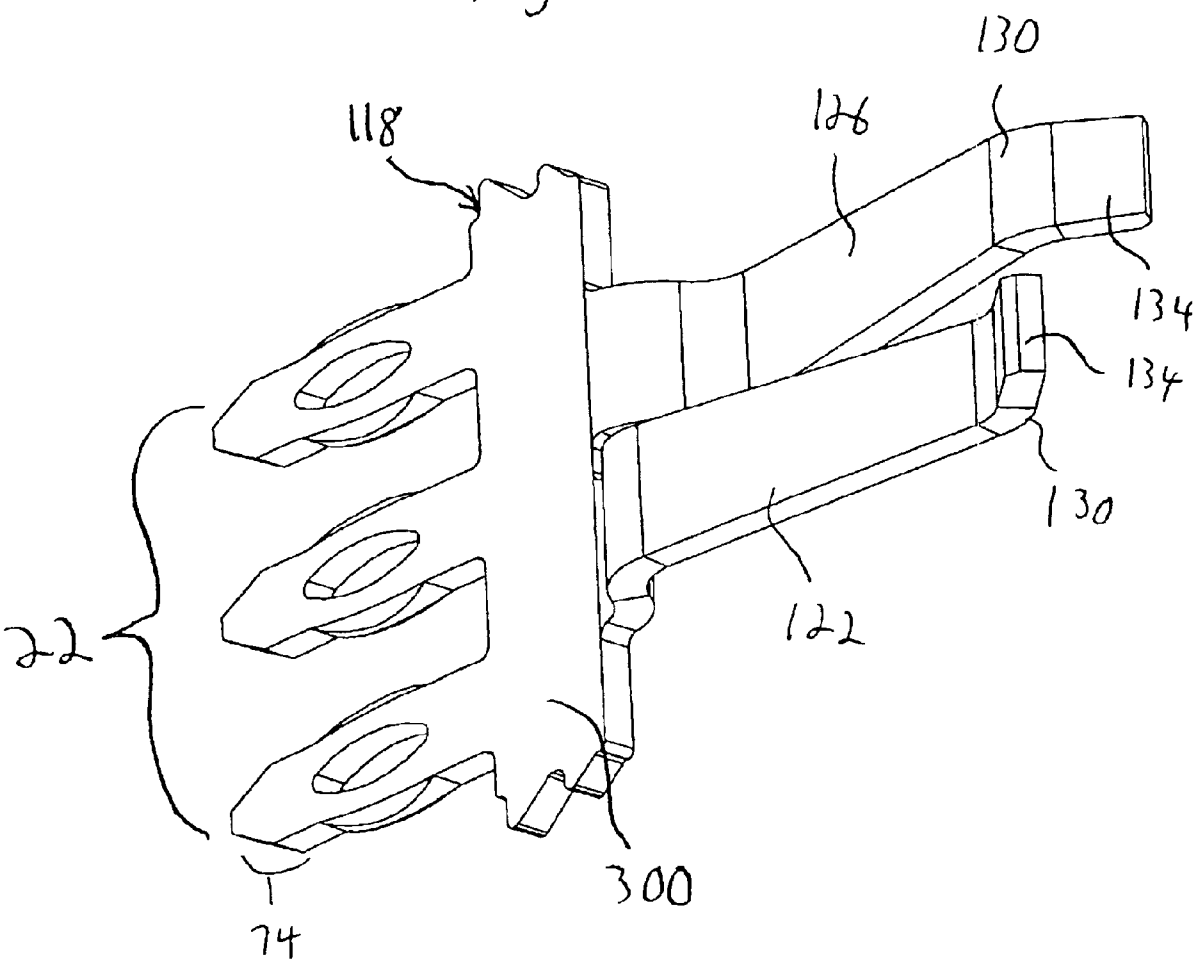
FIG. 3 illustrates an isometric view of a receptacle contact formed according to an embodiment of the present invention.

FIG. 3 illustrates an isometric view of a receptacle contact 118 formed according to an embodiment of the present invention. The compliant pins 22 of each row 74 are all connected to the receptacle contact 118 by a retention beam 300 that is held within the receptacle housing 14 (FIG. 2). Each receptacle contact 118 has a first and second contact prong 122 and 126. The first and second prongs 122 and 126 have contact tips 130 and lead-in beams 134. The receptacle contact 118 receives a plate contact 78 (FIG. 5) of the header housing 18 (FIG. 1) between the contact tips 130 of the first and second contact prongs 122 and 126.

Figure 4:
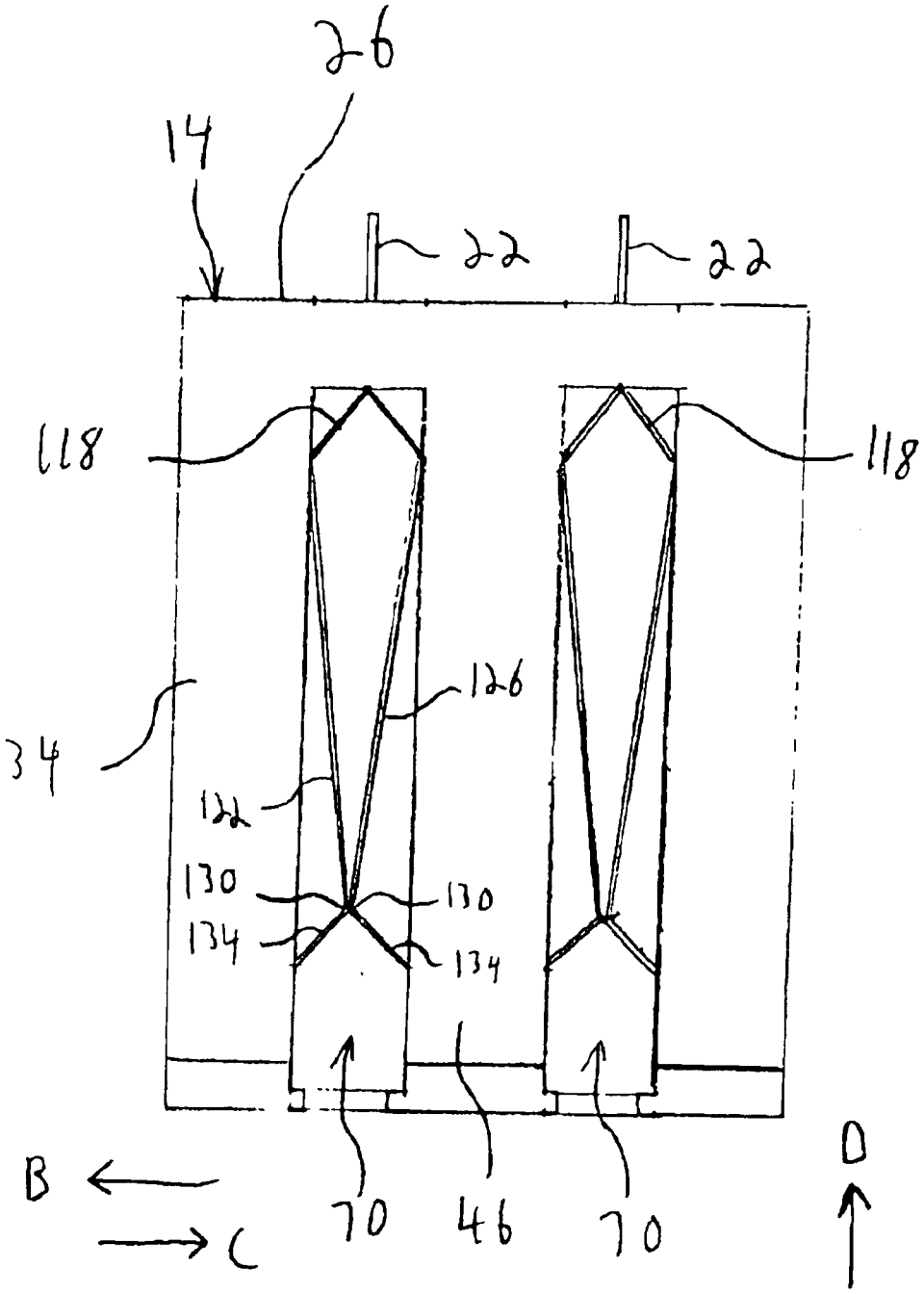
FIG. 4 illustrates a bottom view of the receptacle housing of FIG. 2.

FIG. 4 illustrates a bottom view of the receptacle housing 14 of FIG. 2. The receptacle contacts 118 are partially retained within the receptacle channels 70 with the compliant pins 22 extending from the rear end 26 of the receptacle housing 14. A plate contact 78 (FIG. 5) of the header housing 18 (FIG. 1) is inserted in the direction of arrow D between the first and second contact prongs 122 and 126 such that the plate contact 78 is pinched between the contact tips 130 of the first and second prongs 122 and 126 with the first prong 122 pushed in the direction of arrow B toward a side wall 34 and the second prong 126 pushed in the direction of arrow C toward the divider wall 46. The first and second prongs 122 and 126 electrically connect the plate contact 78 to the compliant pins 22 extending from the receptacle channel 70.

Figure 5:
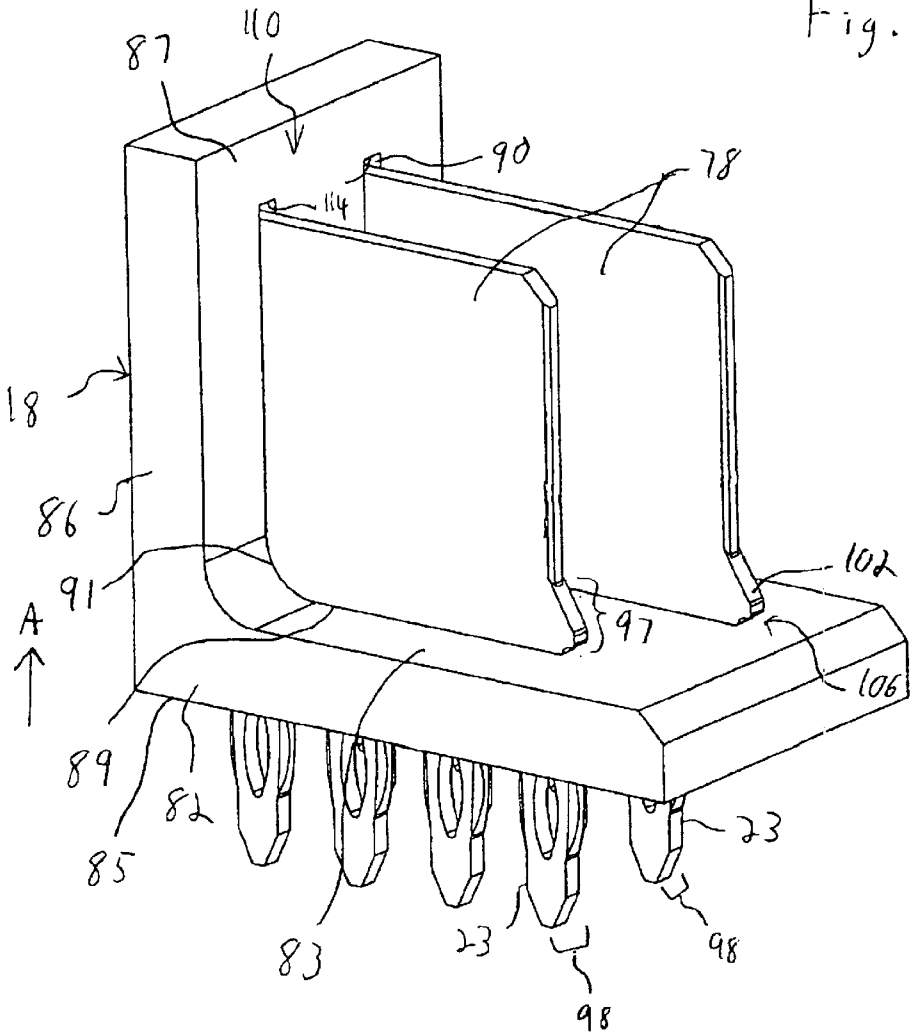
FIG. 5 illustrates an isometric view of the header housing formed according to an embodiment of the present invention.
Figure 6:
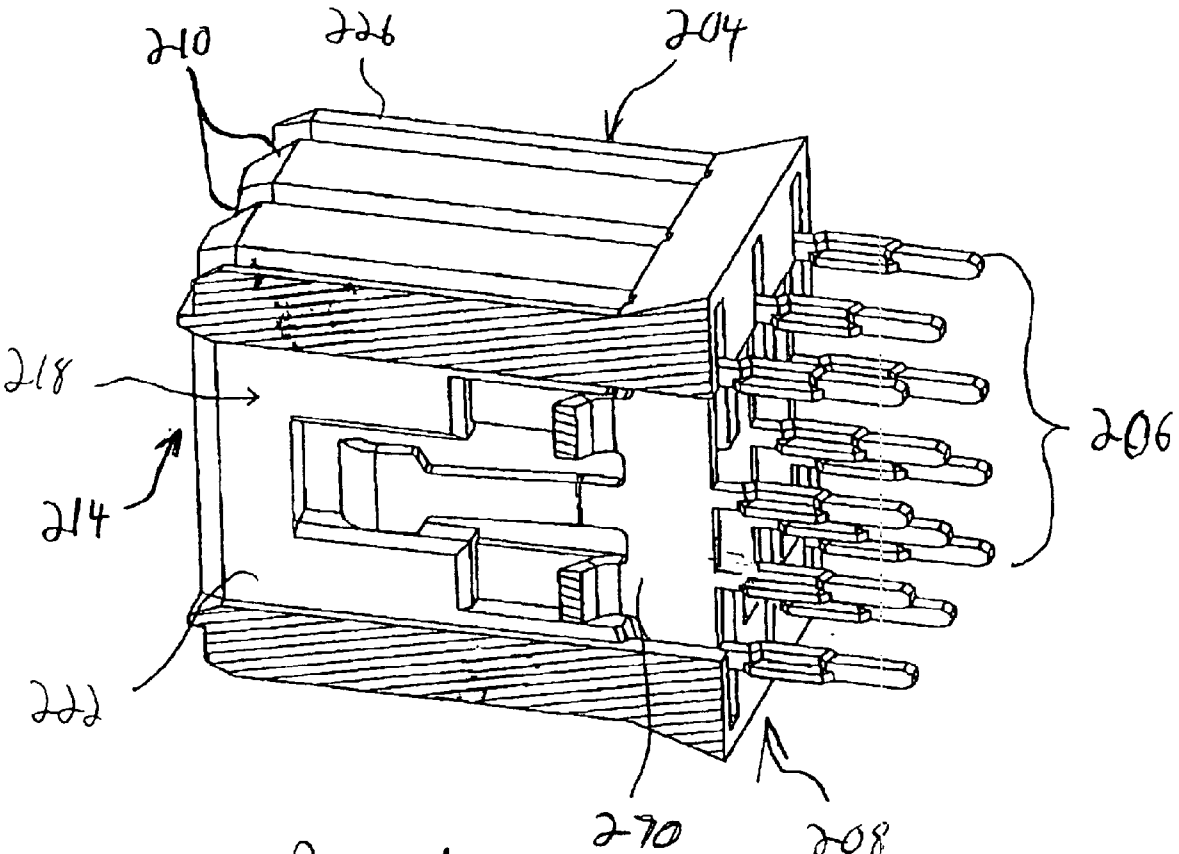
Prior Art Fig. 6
FIG. 6 illustrates a sectional isometric view of a conventional receptacle housing.
Figure 7:
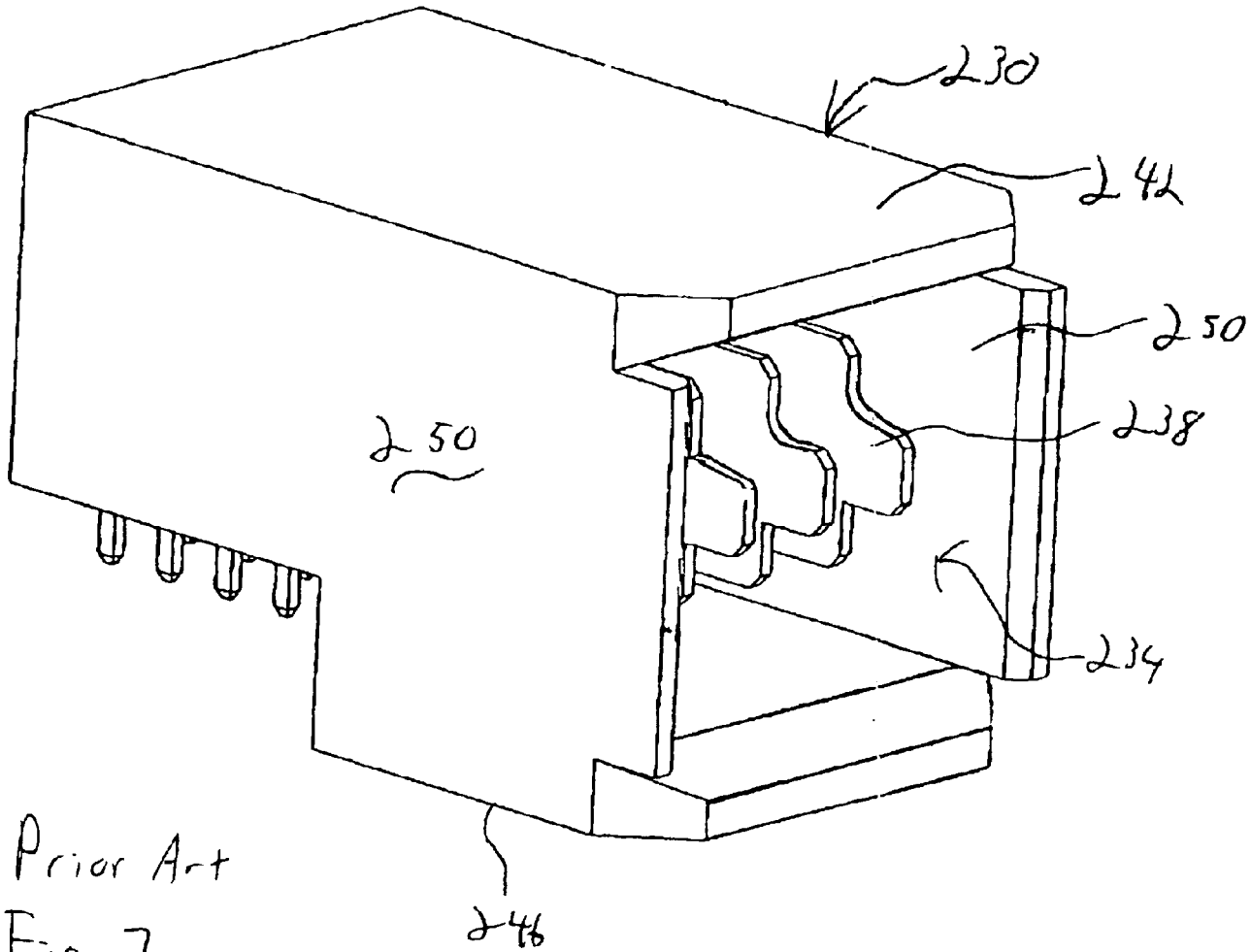
Prior Art Fig. 7
FIG. 7 illustrates an isometric view of a conventional header housing.
Figure 8:
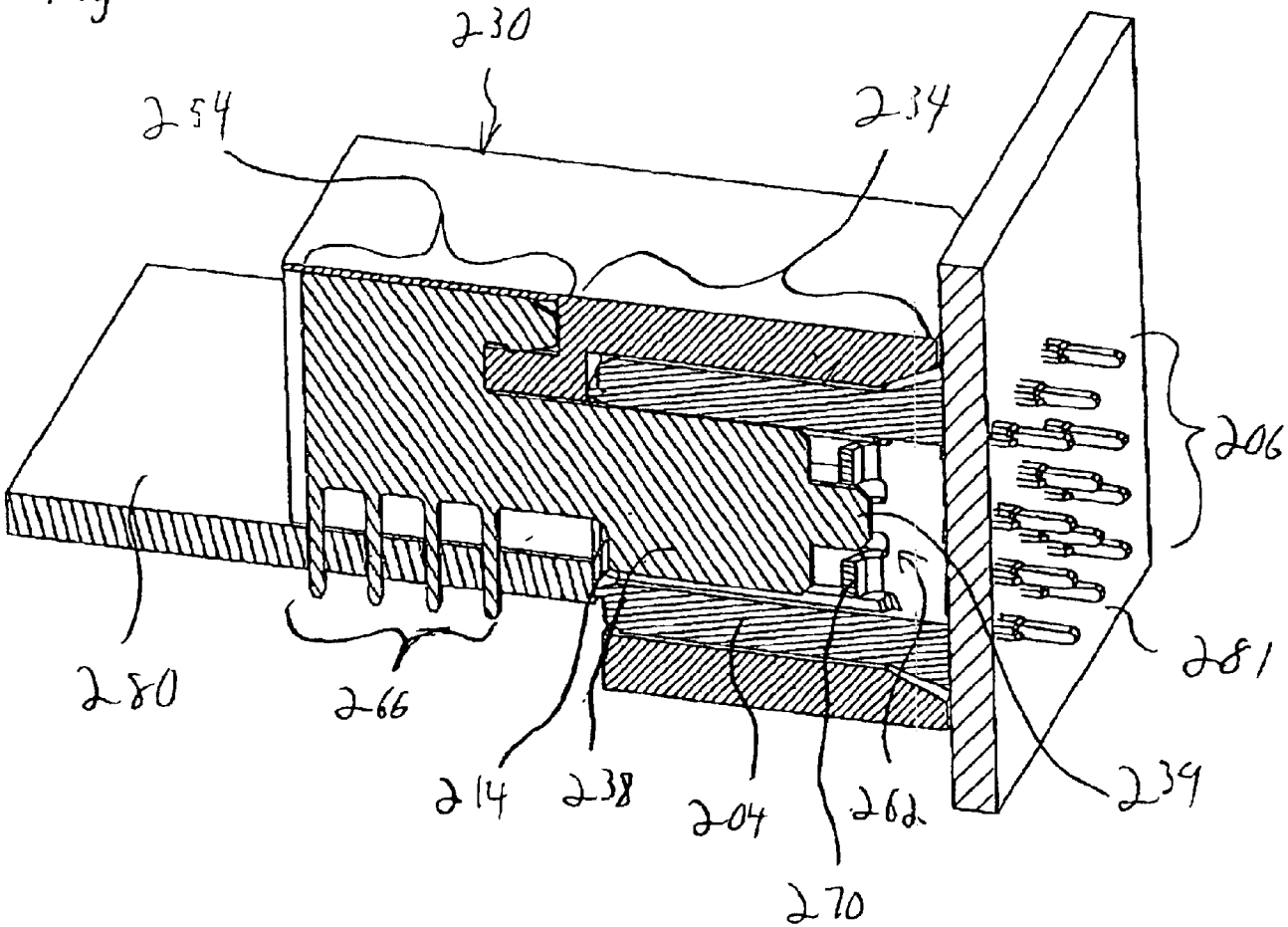
Prior Art Fig. 8
FIG. 8 illustrates a sectional isometric view of the receptacle housing of FIG. 6 engaging the header housing of FIG. 7

FIG. 5 illustrates an isometric view of the header housing 18 formed according to an embodiment of the present invention. The header housing 18 has a rectangular bottom wall 82 formed with, and oriented perpendicular to, a rectangular side wall 86. The bottom wall 82 has a lower face 85 configured to abut against a daughter card or backplane board, and an upper face 83. The bottom wall 82 has rectangular slits 89 that extend therethrough and that intersect, at intermediate portion 91, rectangular cavities 90 extending through only a portion of the side wall 86. The plate contacts 78 are conductive sheets formed with the compliant pins 23 along one edge thereof. The plate contacts 78 are oriented parallel to each other in the cavities 90 in the side wall 86 and the slits 89 in the bottom wall 82. The side walls 86 have rear faces 87. The compliant pins 23 extend through the slits 89. The compliant pins 23 of each plate contact 78 are formed in a row 98 of compliant pins 23 and are parallel to each other and project upward from the upper face 83. The plate contacts 78 have triangular retention wedges 102 along a front end 106 of lower portions 97 and rectangular catches (not shown) at a top end 110. During assembly, when the plate contacts 78 are inserted into the header housing 18 in the direction of arrow A through the slits 89, the retention wedges 102 slide through the slits 89 and resistibly engage the bottom wall 82 and the rectangular catches frictionally engage top inner surfaces 114 of the cavities 90 to hold the plate contacts 78 within the header housing 18.

During mating, the header housing 18 is connected to a daughter card by inserting the compliant pins 23 extending from the bottom wall 82 into apertures in the daughter card until the bottom wall 82 engages the daughter card. The compliant pins 23 are interference fitted into the apertures and engage electrical traces within the daughter card. Returning to FIG. 2, the receptacle housing 14 is likewise connected to a backplane board, such as within a computer cabinet (not shown), by inserting the compliant pins 22 extending from the rear wall 42 into apertures in the backplane board until the rear wall 42 engages the backplane board. The compliant pins 22 are interference fitted into the apertures and engage electrical traces within the backplane board.

Returning to FIG. 1, the header housing 18 is then connected to the receptacle housing 14 by sliding the bottom wall 82 of the header housing 18 along the bottom mating face 54 of the receptacle housing 14 in the direction of arrow D along the longitudinal axis 150. During mating, the plate contacts 78 (FIG. 5) are inserted into the receptacle channels 70 (FIG. 2) through the front slots 58 (FIG. 2) along the longitudinal axis 150 until the side wall 86 of the header housing 18 is resistibly engaged by the front mating face 62 of the receptacle housing 14. The plate contacts 78 may be inserted parallel, or at an acute angle, to the longitudinal axis 150. The bottom slots 50 receive the lower portions 97 (FIG. 5) of the plate contacts 78 immediately adjacent the upper face 83 of the bottom wall 82. The bottom and front mating faces 54 and 62 abut against the upper face 83 and rear face 87. As the plate contacts 78 are slid into the receptacle channels 70, the plate contacts 78 are received between the first and second contact prongs 122 and 126 (FIG. 3) of the receptacle contact 118 (FIG. 3) to electrically connect the daughter card 292 to the backplane board 290. When fully joined, the end 79 of the bottom wall 82 is located proximate the rear end 26.

Optionally, the receptacle and header housings 14 and 18 may be oriented such, that, when connected, the printed circuit boards attached to the receptacle and header housings 14 and 18 are at acute angles or obtuse angles to each other.

Optionally, the receptacle and header housings 14 and 18 may be oriented such that, when connected, the printed circuit boards attached to the receptacle and header housings 14 and 18 are oriented parallel to each other.

The angled connector 10 provides several benefits. Because the plate contacts are retained in an L-shaped housing having only two perpendicular walls and because the receptacle housing has slots leading to receptacle channels on a bottom mating face, the plate contacts can be slid into direct contact with the receptacle contacts within the receptacle housing. Thus, the header housing does not require two separate chambers for the plate contacts and the compliant pins. By removing the second chamber, the header housing is more compact and thus brings the daughter card into contact with the backplane board. By bringing the daughter card closer to the backplane board, the angled connector saves space within the cabinet such that more backplane boards or other applications may be inserted into the cabinet. Additionally, the angled connector need not join printed circuit boards at a right angle to each other. The angled connector can join printed circuit boards at acute or obtuse angles to each other. Finally, because the daughter cards and the backplane board are positioned closer to each other, the current flowing therebetween travels a shorter distance and thus induces less inductance. The reduction in inductance results in faster and more efficient power transmission.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

What is claimed is:

1. An electrical connector comprising:

a first housing having a bottom wall including a lower face configured to adjoin a first circuit board and an opposed upper face, said first housing having a plate contact extending upward from said upper face, said plate contact including a retention wedge that engages said upper face of said bottom wall, said plate contact being configured to electrically communicate through said bottom wall with the first circuit board; and a second housing having a rear wall configured to adjoin a second circuit board and a receptacle channel formed in said second housing, said receptacle channel securely receiving a receptacle contact that is configured to electrically communicate through said rear wall with the second circuit board, said receptacle channel opening onto front and bottom faces of said second housing to define front and bottom slots in said front and bottom faces, respectively, said plate contact being inserted through said front and bottom slots when said first and second housings are joined.

2. The electrical connector of claim 1, wherein said first housing includes a side wall extending from said bottom wall, said side wall including a cavity that retains said plate contact, said side wall abutting against said front face of said second housing when said first and second housings are joined.

3. The electrical connector of claim 1, wherein said plate contact includes compliant pins extending through said lower face of said bottom wall to be received within the first circuit board, and wherein said receptacle contact includes compliant pins extending through said rear wall to be received within the second circuit board such that the first and second circuit boards are located immediately adjacent one another.

4. The electrical connector of claim 1, wherein said bottom wall of said first housing and said rear wall of said second housing are located immediately adjacent one another and are oriented perpendicular to one other when said first and second housings are interconnected.

5. The electrical connector of claim 1, wherein said receptacle contact includes adjacent first and second contact prongs, oppositely angled with respect to one another, and retained in said receptacle channel, said first and second contact prongs receiving said plate contact therebetween, said first and second contact prongs being biased away from each other when said plate contact is received therebetween.

6. The electrical connector of claim 1, wherein said first housing retains a plurality of plate contacts and said second housing includes a plurality of receptacle channels separated by divider walls, each of said receptacle channels receiving a corresponding plate contact.

7. The electrical connector of claim 1, wherein said first housing includes a side wall joined with said bottom wall, said side and bottom walls abutting against said front and bottom faces, respectively, of said second housing when said first and second housings are joined.

8. The electrical connector of claim 1, wherein said first housing includes a side wall joined with said bottom wall, said side and bottom walls covering said front and bottom slots, respectively, in said second housing when said first and second housing are joined.

9. The electrical connector of claim 1, wherein said front and bottom slots are oriented at a right angle to one another.

10. The electrical connector of claim 1, wherein said first housing includes a plurality of plate contacts extending upward from said upper face of said bottom wall, said upper face being substantially unobstructed between adjacent plate contacts.

11. An electrical connector comprising:

a header housing having a bottom wall and a side wall, said bottom wall including a lower face configured to adjoin a first circuit board and an opposed upper face, said header housing having a plate contact extending upward from said upper face, said plate contact including a retention wedge that engages said upper face of said bottom, said plate contact being configured to electrically communicate through said bottom wall with the first circuit board; and a receptacle housing having a rear wall configured to adjoin a second circuit board and a receptacle channel formed in said receptacle housing, said receptacle channel securely receiving a receptacle contact that extends along a longitudinal axis of said receptacle housing and is configured to electrically communicate through said rear wall with the second circuit board, said receptacle channel opening onto front and bottom faces of said receptacle housing to define front and bottom slots in said front and bottom faces, respectively, said plate contact being inserted through said front and bottom slots when said header and receptacle housings are joined.

12. The electrical connector of claim 11, wherein said side wall includes a cavity that retains said plate contact, said side wall abutting against said front face of said second housing when said header and receptacle housings are joined.

13. The electrical connector of claim 11, wherein said plate contact includes one of compliant pins and solder tail pins extending through said lower face of said bottom wall to be received within the first circuit board, and wherein said receptacle contact includes compliant pins extending through said rear wall to be received within the second circuit board such that the first and second circuit boards are located immediately adjacent one another.

14. The electrical connector of claim 11, wherein said header housing retains a plurality of plate contacts and said receptacle housing includes a plurality of receptacle channels separated by divider walls, each of said receptacle channels receiving a corresponding plate contact.

15. The electrical connector of claim 11, wherein said side wall is joined with said bottom wall, said side and bottom walls abutting against said front and bottom faces, respectively, of said receptacle housing when said header and receptacle housings are joined.

16. The electrical connector of claim 11, wherein said side wall is joined with said bottom wall, said side and bottom walls covering said front and bottom slots, respectively, in said receptacle housing when said header and receptacle housings are joined.

17. The electrical connector of claim 11, wherein said front and bottom slots are oriented at a right angle to one another.

18. An electrical connector comprising:

a first housing comprising:

a bottom wall including a lower face configured to adjoin a first circuit board and an opposed upper face, said bottom wall defining a rectangular slit therethrough;

a plate contact received through said slit and extending upward from said upper face, said plate contact being configured to electrically communicate through said bottom wall with the first circuit board;

a side wall extending from said bottom wall, said side wall including a cavity that retains said plate contact, wherein said slit and said cavity intersect within an intermediate portion of said bottom wall adjoining said bottom wall and said side wall; and a second housing comprising:

a rear wall configured to adjoin a second circuit board; and a receptacle channel formed in said second housing, said receptacle channel securely receiving a receptacle contact that is configured to electrically communicate through said rear wall with the second circuit board, said receptacle channel opening onto front and bottom faces of said second housing to define front and bottom slots in said front and bottom faces, respectively, said plate contact being inserted through said front and bottom slots when said first and second housings are joined.

19. The electrical connector of claim 18, wherein said first housing includes a plurality of plate contacts extending upward from said upper face of said bottom wall, said upper face being substantially unobstructed between said plate contacts.

20. The electrical connector of claim 18, wherein said plate contact includes a retention wedge that engages said upper face of said bottom wall.

21. An electrical connector comprising:

a first housing comprising:

a bottom wall including a lower face configured to adjoin a first circuit board and an opposed upper face; and a plate contact extending upward from said upper face, said plate contact being configured to electrically communicate through said bottom wall with the first circuit board; and a second housing comprising:

a rear wall configured to adjoin a second circuit board;

a receptacle channel formed in said second housing, said receptacle channel opening onto front and bottom faces of said second housing to define front and bottom slots in said front and bottom faces, respectively; and a receptacle contact securely received in said receptacle channel, and configured to electrically communicate through said rear wall with the second circuit board, said receptacle contact including adjacent first and second contact prongs oppositely angled with respect to one another, said plate contact being inserted through said front and bottom slots to be received between said prongs when said first and second housings are joined.

22. The electrical connector of claim 21, wherein said receptacle contact comprises:

a retention beam held within said receptacle channel;

a plurality of terminal pins extending from a first side of said retention beam to electrically communicate through said rear wall; and first and second contact prongs extending from an opposite second side of said retention beam within said receptacle channel, said contact prongs being disposed adjacent one another along said second side and oppositely angled with respect to one another and said retention beam so that said prongs are biased away from each other when said plate contact is received therebetween.

* * * * *